US006339942B1

(12) United States Patent
Majer et al.

(10) Patent No.: US 6,339,942 B1
(45) Date of Patent: Jan. 22, 2002

(54) COMPOUND NEEDLE WITH ASYMMETRICALLY DIVIDED CLOSING ELEMENT

(75) Inventors: Sigmar Majer, Balingen (DE); Bernhard Schuler, deceased, late of Sonnenbühl-Erpfingen (DE), by Ursula Schuler, legal representative; Kurt Wiedenhöfer, Albstadt (DE); Toshiaki Morita; Kenji Kitahara, both of Wakayama (JP)

(73) Assignees: Groz-Beckert KG, Albstadt (DE); Shima Seiki Manufacturing Ltd., Wakayama (JP)

( * ) Notice: Subject to any disclaimer, the term of this patent is extended or adjusted under 35 U.S.C. 154(b) by 0 days.

(21) Appl. No.: 09/690,740

(22) Filed: Oct. 18, 2000

(30) Foreign Application Priority Data

Oct. 18, 1999 (DE) ..... 199 50 259

(51) Int. Cl.[7] ..... D04B 35/06
(52) U.S. Cl. ..... 66/120; 66/116
(58) Field of Search ..... 66/116, 120, 121, 66/123

(56) References Cited

U.S. PATENT DOCUMENTS 1,461,007 A * 7/1923 Taft ..... 66/120
1,673,634 A 5/1928 Page
3,584,481 A * 6/1971 Hayashi ..... 66/120
4,005,589 A 2/1977 Uhlir
4,043,153 A * 8/1977 Lindner et al. ..... 66/120
5,937,673 A * 8/1999 Shima ..... 66/120

FOREIGN PATENT DOCUMENTS

| | | |
|---|---|---|
| DE | 21 46 981 | 4/1972 |
| DE | 1 635 847 | 4/1973 |
| DE | 31 23 785 | 5/1982 |
| DE | 44 30 705 | 3/1996 |
| EP | 0 875 614 | 11/1998 |

* cited by examiner

*Primary Examiner*—Danny Worrell
(74) *Attorney, Agent, or Firm*—Venable; Gabor J. Keleman

(57) ABSTRACT

A compound needle comprises a closing element with two closing element springs. These are designed to be asymmetrical relative to each other or at least provided with clearances or openings which, during the operation of the compound needle, are made to overlap with a corresponding cutout or other openings in the basic compound needle member, so that deposits can be removed to the needle channel. An asymmetric design of the closing element springs prevents the closing element from being wedged into the closing element channel, even if the deposit removal is incomplete. As a result, the compound needle wear is reduced considerably and the operational safety is increased.

15 Claims, 6 Drawing Sheets

COMPOUND NEEDLE WITH ASYMMETRICALLY DIVIDED CLOSING ELEMENT

CROSS REFERENCE TO RELATED APPLICATION

This application claims the priority of German Application No. 199 50 259.5 filed Oct. 18, 1999, which is incorporated herein by reference.

BACKGROUND OF THE INVENTION

The invention relates to a compound needle, having the features as defined in the preamble to patent claim 1 or patent claim 2.

Compound needles, such as the ones used for flat knitting machines or circular knitting machines, consist of a needle member with a closing element channel, inside of which a closing element is positioned such that it can be displaced. A needle head in the form of a hook is formed onto the free end of the needle member. The hook can be opened or closed by the closing element. The knitting machine comprises at least one flat or one cylinder-shaped and/or one plate-shaped needle bed containing respectively several needle channels. The compound needles are arranged inside these needle channels such that they can be displaced in longitudinal direction, wherein they perform a back-and-forth movement in longitudinal direction during the knitting operation. The closing element must perform a coordinated back-and-forth movement, for which it is provided with a so-called butt that functions as a means for transmitting movement and makes contact with curved surfaces. Curved surfaces of this type are, for example, the flanks of a so-called cam channel.

During the knitting operation, the head as well as the closing element of the compound needle come in contact with the yarn. As a result, dust or filament particles can be deposited on the closing element, depending on the composition of the yarn as well as the amount of dirt that is carried along. For example, if wool is used for the knitting, dust particles clinging to the wool, salt crystals stemming from the washing of the wool, sand or short filaments can be deposited on the closing element. As a result of the back-and-forth movement of the closing element, these particles can reach the closing element channel and lead to difficulties.

A compound needle of this type with divided closing element is known from U.S. Pat. No. 1,673,634. The closing element is composed of two connected closing element springs, which respectively push past the hook of the compound needle on the side and are spread apart in this way.

The arrangement of the compound needle disclosed in German Published Application 44 30 705, to which corresponds British Patent No. 2,292,953, is similar. The closing element in this case is also formed by two closing element springs, which are spread apart by moving past the hook on the side, thereby making it possible for dirt to be deposited between the closing element springs.

The same is true for the compound needle according to European Patent 08 75 614 to which corresponds U.S. Pat. No. 5,937,673. The compound needle comprises a needle member with needle channel, inside of which a closing element is guided. The closing element consists of a closing element base member that holds two closing element springs, which are designed to be symmetrical relative to each other. The needle hook periodically spreads apart the closing element springs during the operation, thereby allowing dirt and fiber residues to reach the gap defined between the closing element springs.

German Unexamined Patent Application 21 46 981 furthermore discloses a needle base member for a compound needle, which has a closing element channel with rear openings. The two walls on the side of the closing element channel are formed continuously, without openings, and between them limit the closing element channel. The closing element guided therein has elongated holes through which guide pins extend. The guide pins are respectively anchored in the side walls of the closing element. The closing element has a one-piece design.

German Published Patent Application 31 23 785 discloses another known compound needle. The known compound needle comprises a closing element divided into two closing element springs, which are designed to be symmetrical relative to each other. The closing element is arranged inside a compound needle closing element channel that is closed on three sides. An opening in the form of an elongated hole through which a guide pin extends is provided for guiding the closing element.

The problem with this as well as most of the previously mentioned compound needles is that dirt can reach the area between the two closing element springs. If that case occurs, it can lead to a gradual spreading apart of the closing element springs inside the closing element channel, so that with increasing amounts of dirt, the closing element can only be moved with difficulty inside the channel. In turn, this leads to increased friction and wear. In the extreme case where the closing element is extremely hard to move or is wedged inside the channel, the loop formation, the loop transfer and the loop knockover are obstructed. Given another extreme case, the closing elements can no longer be moved inside the closing element channel of the needle member, so that a butt break occurs.

SUMMARY OF THE INVENTION

Based on this assumption, it is the object of the invention to create a compound needle with little tendency to accumulate dirt.

This object is solved alternately with the compound needle according to claim 1 or the compound needle according to claim 2.

Both solutions have in common that the divided closing element is not as likely to become wedged in as a result of stress caused by dirt. The closing element channel contains at least one area in which fiber residues can accumulate without causing the closing element springs to spread apart. According to claim 1, the closing element springs are designed to be asymmetrical relative to each other. It means that they can overlap only partially in the closing element channel and thus do not fill out parts of the channel, which by itself creates additional buffer space in the closing element channel for holding foreign matter. Thus, a wedging in of the closing element is less likely and does not occur as quickly. In addition, the closing element channel is advantageously open on the side, meaning at least one of the channel sidewalls is provided with an opening or clearance. Alternatively or in addition, one or more openings can be provided in the bottom of the closing element channel. The opening on the side can be formed as a cutout in the closing element channel wall. Owing to the relative movement between closing element and needle base member, deposits that can reach the closing element channel wall because of the asymmetry of the two closing element springs can be moved through these openings or clearances into the needle channel. They are removed from the needle channel as a result of the relative movement between the compound needle and the needle channel.

The compound needle according to claim 2 is also based on this principle. Openings in the closing element springs initially permit deposits that have accumulated between the closing element springs to move from the gap formed between the closing element springs to the closing element channel walls and through the openings in these walls to the outside.

By preventing deposits that have accumulated between the closing element springs from forcedly spreading apart the closing element springs and wedge them against the closing element channel walls, the easy movement of the compound needle is maintained continuously, even if yarns with relatively high dirt loads must be processed. The compound needle according to the invention thus proves to have little tendency to accumulate dirt.

It is advantageous if the compound needles contain openings, which are arranged at different locations on the two closing element springs. The openings simultaneously create areas for holding and moving through the dirt that has entered the closing element channel, thus preventing dirt from being wedged between the closing element springs. In part, this also applies if the openings are arranged such that they overlap in some areas. The overlapping of the openings minimizes regions between the closing element springs, in which dirt could settle and spread apart the closing element springs.

One advantageous embodiment of the compound needle comprises a multi-part closing element, composed of a closing element member and closing element springs. These parts (closing element springs and closing element base member) can be rigidly connected or such that they can be detached. The closing element springs comprise web areas and web sections that extend in longitudinal direction of the channel, are displaced relative to each other and preferably do not overlap. With these, the above-mentioned advantages are realized to a particular degree. The web areas and web sections preferably extend through the closing element channel and are guided on the side by the channel sidewalls. The web sections change to guide sections for a guidance parallel to the closing element walls. These guide sections are preferably displaced relative to each other in longitudinal direction to prevent dirt from accumulating between the guide sections.

In addition, the closing element springs can also be designed asymmetrical between the guide sections and a respective loop-support section, which also leads to a reduced tendency for accumulating dirt and being wedged in. The closing element springs thus for the most part are not designed to overlap.

It is advantageous if the asymmetrically designed sections of the closing element springs are primarily arranged in the closing element channel. This results in a good side guidance of the closing element springs, which permits a reliable operation of the compound needle even at a high operating speed.

Further details of advantageous embodiments of the invention follow from the drawing, the description or the dependent claims.

BRIEF DESCRIPTION OF THE DRAWINGS

Exemplary embodiments of the invention are illustrated in the drawings, which show in.

DESCRIPTION OF THE PREFERRED EMBODIMENTS

Figure 1:
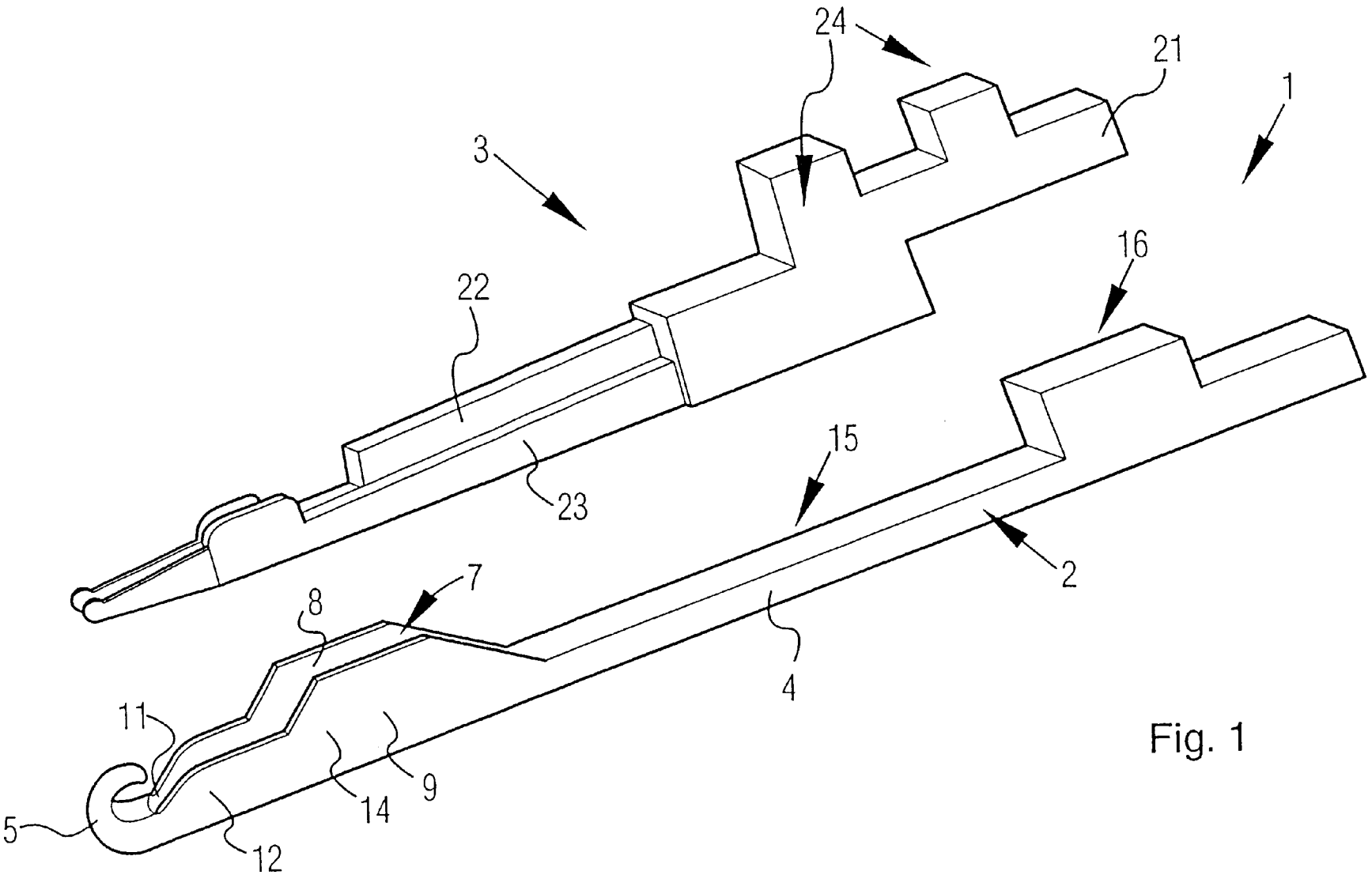
FIG. 1 A compound needle according to the invention in a perspective exploded view.

FIG. 1 shows a compound needle 1 with a needle member 2, a closing element 3 that consists of two closing element springs 22, 23 and a closing element member 21. The needle member 2 is inserted into the needle channel of a knitting machine and is provided for this with an elongated needle shank 4 with a hook 5 on its free end. The needle shank 4 extends in a straight line in longitudinal direction away from the hook 5. Directly following the hook 5 starts a slot-shaped closing element channel 7, which is limited on both sides by two channel side walls 8, 9. The channel sidewalls 8, 9 are flat, plate-shaped structures that project upward at a distance and parallel to each other from the needle base member 2. Starting with a slot beginning 11, they initially increase in height. In a first region 12 that follows this region with increasing height, the height of sidewalls 8, 9 remains approximately constant. Following a further increase in height, the side walls 8, 9 then continue in a region 14 with increased height. The closing element channel 7 therefore comprises two different guide sections, which are formed by regions 12, 14.

Relative to the longitudinal direction of the needle base member 2 and starting with the hook 5, the channel side walls 8, 9 are long enough so that they do not completely emerge from a needle channel during the operational use of the compound needle 1. The compound needle 1 is thus provided with at least a portion of its guidance.

Following the region carrying the channel side walls 8, 9, the needle base member 2 is provided with an elongated opening 15, which is limited in longitudinal direction on one side by the channel side walls 8, 9 and on an other side by a projection 16. The opening 15 forms a region where the closing element channel 7 is open. However, it is also possible to provide openings on the side or in the bottom in place of the opening 15.

Figure 4:
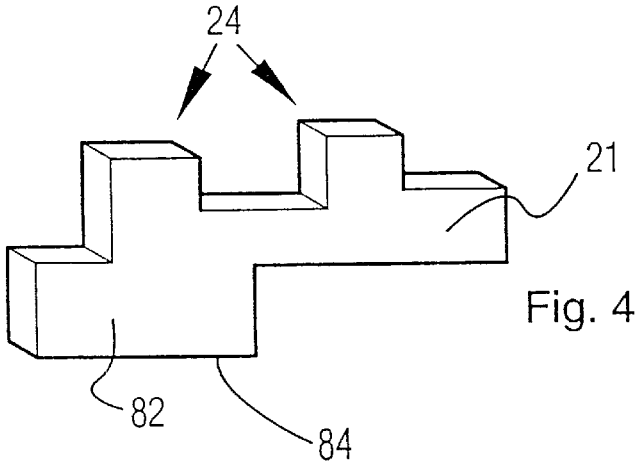
FIG. 4 A view from the side of the closing element base member 21 of closing element springs 22, 23 of the compound needle 1 according to FIG. 1.

The closing element 3 has a closing element member 21 (FIG. 4) and two closing element springs 22, 23 which are held against the closing element member 21. The closing element member essentially consists of an elongated member with rectangular cross section on which one butt or several butts 24 are formed. These project at a right angle away from the closing element member 21 and function to drive the same. During the operation, they engage in the cam channel of a cam and are moved by this cam relative to the needle base member 2. In its frontal region, the closing element member 21 has a receiving area 82 with which the closing element springs 22, 23 are connected. The closing element member 21 has a planar surface 84 on its side facing the needle member 2. The thickness of the closing element base member 21 is approximately the same as that of the needle base member 2.

The closing element 3 can be produced as one piece, consisting of the closing element member 21 and the two closing element springs 22, 23, wherein these can be connected detachably or non-detachably with the closing element member 21. They operate as one part.

Figure 2:
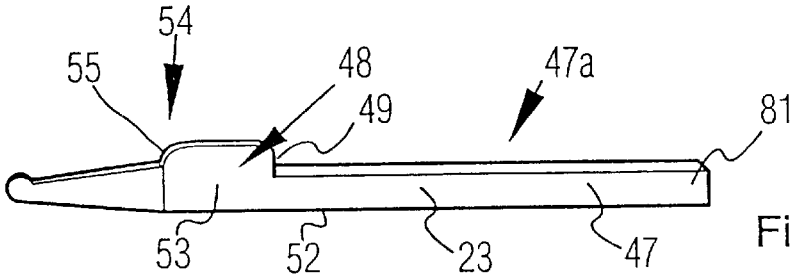
FIG. 2 and FIG. 3 A view from the side of the closing element springs 22, 23 of the compound needle 1 according to FIG. 1.
Figure 3:
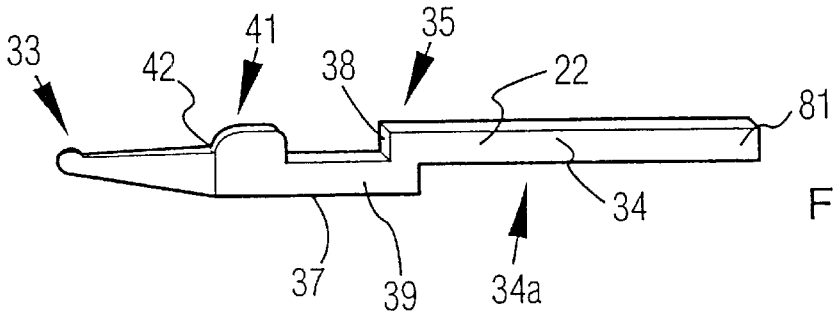

FIGS. 2 and 3 show separate illustrations of the closing element springs 22, 23. The closing element spring 22 essentially has an elongated member with rectangular cross section. Starting with the spring end region 81, a web area 34 extends all the way to a guide section 35. The guide section is arranged so as to maintain a clear distance to the bottom of the closing element channel 7 if the closing element spring 22 is inserted into or attached to the needle base member 2. In other words, the closing element spring 22 contains a clearance or opening 34*a* in the web area 34.

The web section 34 is followed by a guide section 35 of approximately the same height as the closing element channel 7, which in special cases can even projects over this channel. The guide section 35 is provided with a lower contact surface 37, which fits flush against the level bottom of the closing element channel 7 during the operation and thus also marks its height in FIG. 3.

The guide section 35 is limited by a step 38 on the side facing the hook 5 or the loop-holding nose 33, which step is at a right angle to the contact surface 37 where it changes to a narrow web section 39. The web section 39 carries a plate-shaped, larger section 41, which secures a loop-support shoulder 42 on the side facing the loop-holding nose 33.

Relative to the closing element spring 22, the closing element spring 23, shown in FIG. 2, is asymmetrical in some sections. Both closing element springs 22, 23 are not mirror-symmetrical with respect to an imaginary plane between the two. A web area 47 that extends from the end region 81 of closing element spring 23 to a guide section 48 changes into this guide section via a steep step 49. The closing element spring 23 is provided starting from the top with an opening 47*a*, which advantageously overlaps on the side with the web area 34 of closing element spring 22. Both openings 34*a*, 47*a* can be large enough to overlap in part on their broad sides. A contact surface 52 is formed on the closing element spring 23, on the side opposite the opening 47*a*. This lower contact surface 52 fits flush against the bottom of closing element channel 7.

The guide section 48 of closing element spring 23 is offset against the guide section 35 of closing element spring 22 in longitudinal direction, in such a way that the steps 38, 49 are arranged at a distance to each other. In some application cases, the closing element springs 22, 23 are embodied such that the two steps 38, 49 overlap or are aligned with each other. The web areas 34, 47 are for the most part arranged such that they do not overlap which follows in particular from FIGS. 1 and 5. The guide section 48 of closing element spring 23 changes without interruption via a web section 53 or an opening (not shown here) to a plate-shaped section 54. This section is designed to be mirror-symmetrical to section 41 of the closing element spring 22 and secures a loop-support shoulder 55.

Figure 5:
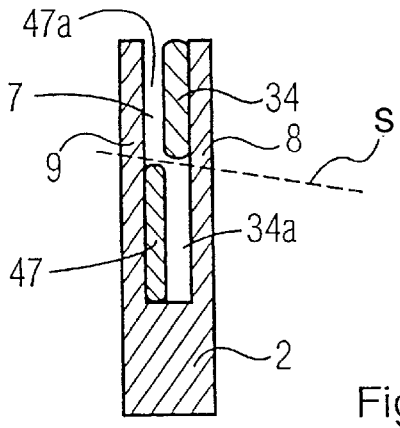
FIG. 5 The compound needle according to FIG. 6, in a sectional view along the line VI—VI and at a different scale.
Figure 6:
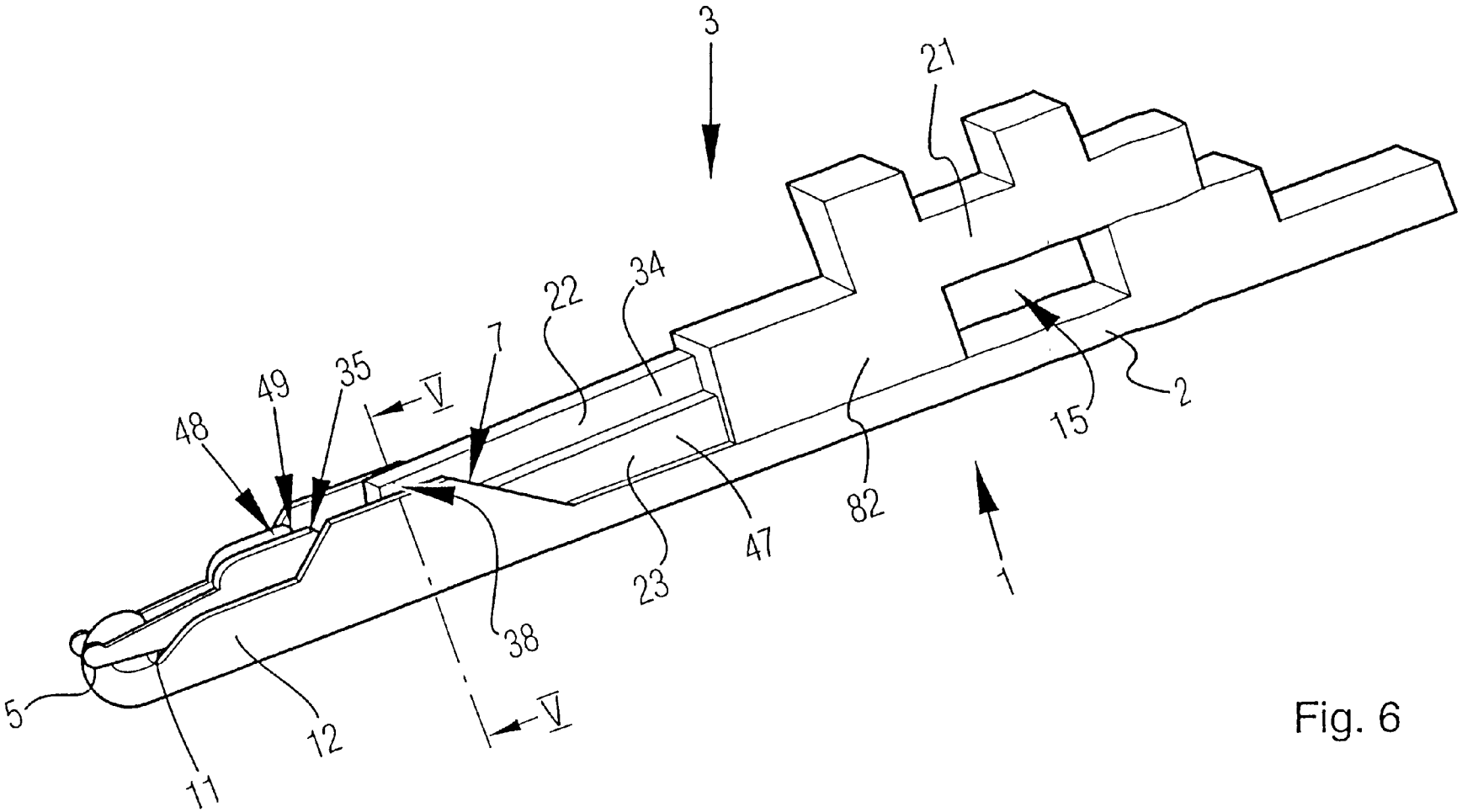
FIG. 6 A perspective view of the compound needle according to FIG. 1 with closing element.

FIG. 6 contains details of the design of compound needle 1 and, in particular, of the closing element springs 22 and 23. In the assembled state, the holding area 82 of closing element member 21 engages in the opening 15 of needle member 2. The closing element springs 22, 23 freely extend through the closing element channel 7, wherein the web areas 34, 47 do not overlap essentially, as follows from FIGS. 5 and 6. As shown in FIG. 5, the lower edge of the web area 34 can be arranged approximately at the same level as the upper edge of the web area 47. However, in many cases it may be advantageous to leave a space, so that the lower edge of the web area 34 is arranged clearly above the upper edge of the web area 47 and the openings 34*a*, 47*a* overlap. A gap S then forms, which is inclined toward the channel side wall 8, 9.

It may additionally be advantageous if the web area 47 does not fit over its complete length against the bottom of closing element channel 7.

The steps 38, 49 of guide sections 35, 48 are at a distance to each other in longitudinal direction, so that these do not overlap. The closing element channel 7 extends far in the direction toward hook 5, as illustrated clearly in FIGS. 1 and 6. The start of slot 11 is therefore arranged directly adjacent to the hook 5. The frontal region 12 of closing element channel 7 provides guidance for the web sections 39, 53 until very close to the hook 5.

The compound needle 1 described so far functions as follows:

During the operation, the closing element 3 performs a back-and-forth movement relative to the needle base member 2. In a pulled-back position, the closing element springs 22, 23 are pulled back almost completely into the closing element channel 7. The receiving area 82 of closing element member 21 clears a frontal portion of opening 15, thereby freeing a large-area passage between closing element channel 7, past the closing element channel side walls 8, 9, to the needle channel sides.

If the closing element 3 is then displaced against the needle member 2, the hook 5 enters the gap between the loop-holding noses and somewhat spreads apart the closing element springs 22, 23. In the process, filaments, dust or other deposits can also reach the area between the closing element springs 22, 23. If the closing element 3 is subsequently returned to the pulled-back position, the closing element springs 22, 23 are not longer spread apart and are pulled back into the closing element channel 7 together with the dirt that has entered the gap. However, filaments or other dirt carried along does not lead to the closing element springs 22, 23 being wedged into the closing element channel 7, not even if new deposits constantly enter the gap during many successive lifts. The web areas 34, 47 dot not press against each other, but past each other. The compound needle is therefore for the most part insensitive to dirt accumulation. Any dirt carried along is furthermore removed through the relative movement between the web areas 34, 47 and the channel side walls 8, 9 to the opening 15 and through this opening into the needle channel.

Figure 7:
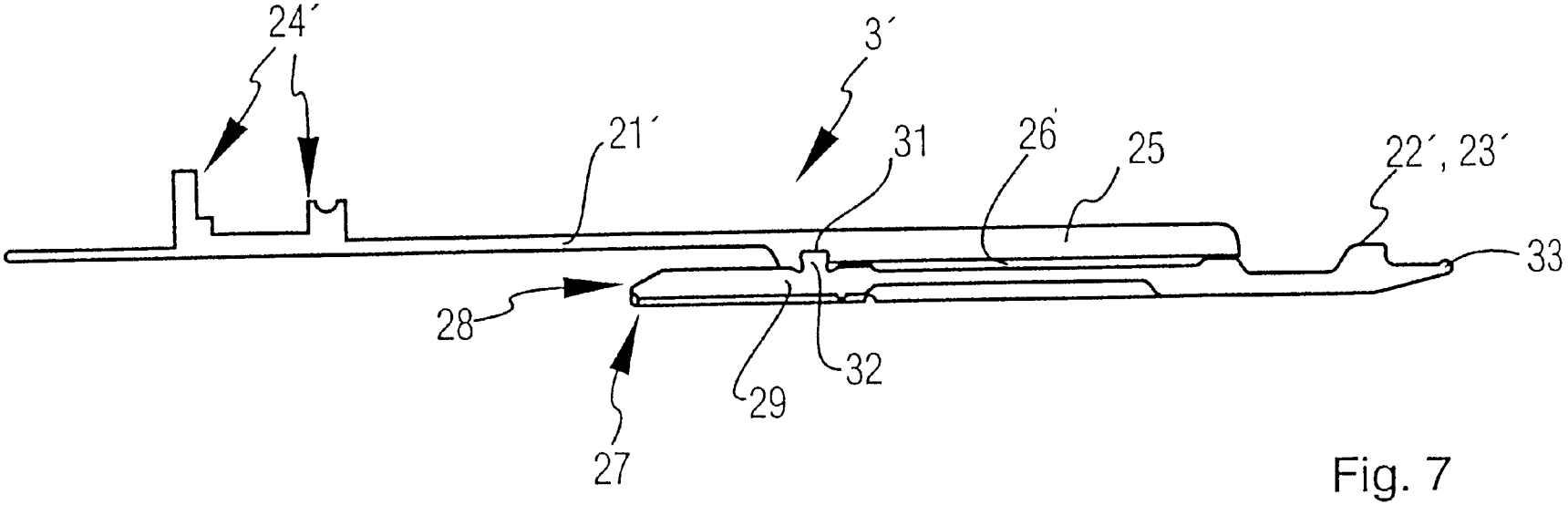
FIG. 7 A view from the side of a closing element for a modified version of a compound needle.

FIG. 7 shows a modified version of a closing element 3. It contains a closing element member 21' and two closing element springs 22', 23' that are held against the closing element member 21'. The closing element 3' can also be designed as one piece. The closing element member 21' is essentially an elongated web with rectangular cross section and one or several formed-on butts 24. These butts project at right angles away from the closing element member 21' and function as its drive. During the operation, they engage in the cam channel of a cam and are moved by it relative to the needle base member 2.

The frontal region of closing element member 21' contains a guide section 25 on which a planar surface 26 is formed on the side facing the needle member 2. The guide section has the same thickness as the section of closing element member 21' that extends to the butts 24' and coincides approximately with the thickness of needle base member 2.

The guide section 25 is followed by a holding section 27, which projects away from the closing element member 21' and into the opening 15. The height of holding section 27 here coincides with the depth of the opening 15. However, it is shorter in longitudinal direction than the opening 15, so that a considerable longitudinal movement of the closing element 3' is possible.

The holding section 27 of closing element 3' furthermore contains a flat, wide groove 28 that is open on the side and is designed to accommodate holding ends 29 of the closing element springs 22', 23', which are wedged into a window-like opening 31 of the closing element member 21'.

Starting with the holding ends 29, the closing element springs 22', 23' extend past a window-like opening 31 or a fastening location. They respectively engage with one fastening flange 32 in the window-like opening 31 and can be wedged into this opening. A loop-holding nose 33 forms the outermost end on the opposite side.

Figure 8:
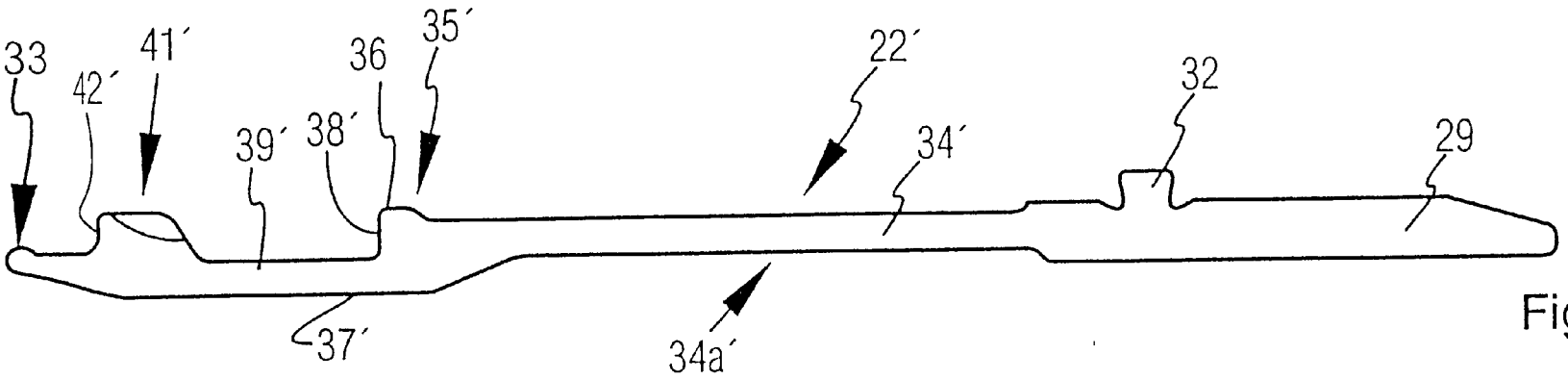
FIGS. 8 and 9 A side view of the closing element springs belonging to the closing element according to FIG. 7.
Figure 9:
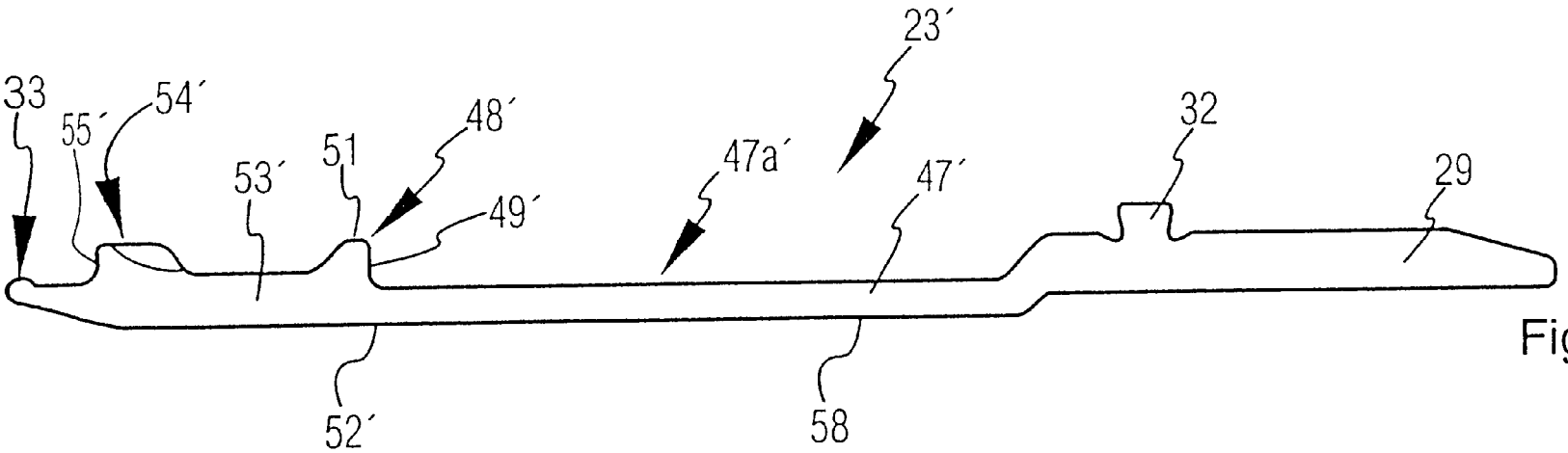

The closing element springs 22', 23' are shown separately in FIGS. 8 and 9. The closing element spring 22' is essentially an elongated member with rectangular cross section. Starting with its holding region 29, a web area 34' extends to a guide section 35'. Following the fastening flange 32, the closing element spring 22' changes to a web area 34' that is not as high as the side walls 8, 9 of the needle base member. The web area is arranged so as to maintain a clear distance to the bottom of the closing element channel 7 if the closing element 3' is inserted into or fitted onto the needle base member 2. In other words, the closing element spring 22' has a clearance or opening 34*a*' in the web area 34'.

Connecting to the web area 34' is a guide section 35', which has approximately the same height as the closing element channel 7 and exceeds this height in special applications. At the upper end, it is provided with a contact surface 36 for the planar surface 26 of guide section 25 of closing element member 21'. On the opposite side, the guide section 35' is provided with a lower contact surface 37', which fits flush against the level bottom of the closing element channel 7 during the operation and thus also marks its height in FIG. 8.

The guide section 35' is limited by a step 38' on the side facing the hook 5 or the loop-holding nose 33, which step is aligned at a right angle to the contact surface 37' where it then changes to a narrow web section 39'. This web section 39' carries a plate-shaped, larger section 41' that secures a loop-support shoulder 42' on the side facing the loop-holding nose 33.

The closing element spring 23' shown in FIG. 9 has an asymmetrical design in some sections, relative to the closing element spring 22'. Both closing element springs 22', 23' are not mirror-symmetrical with respect to an imaginary plane between them. With the closing element spring 23', a web area 47' extends from the holding end 29 to a guide section 48' into which it changes via a steep step 49'. The closing element spring 23' is provided from the top with an opening 47*a*', which preferably overlaps on the side with the web area 34' of closing element spring 22'. The dimensions of both openings 34*a*' and 47*a*' can be such that they partially overlap on their broad sides. The guide section 48' has a contact surface 51 on the top, which fits flush against the planar surface 26 of closing element member 21' during the operation. On the lower side opposite the contact surface 51, a contact surface 52' is formed on the closing element spring 23', which extends over a large portion of the web area 47'. This lower contact surface 52' fits flush against the bottom of contact element channel 7.

Stated generally, and with particular reference to FIGS. 5, 8 and 9, the two closing element springs 22', 23' have mutually longitudinally aligned length portions of unlike configuration. Thus, the web portion 34' of the closing element spring 22' is in longitudinal alignment with the web portion 47' of the closing element spring 23', but the web portions 34' and 47' are differently shaped. Similar considerations apply to the mutually longitudinally aligned web portions 39' and 53' of the respective closing element springs 22' and 23'. As a result, such longitudinally aligned length portions have parts that are offset with respect to one another as viewed perpendicularly to the longitudinal direction of the closing element springs 22', 23'. In particular, as a comparison of FIGS. 8 and 9 shows, and as it may also be seen in the sectional FIG. 5 for the web portions 34 and 47, the web portions 34' and 47' extend in their entirety at different height positions and are thus entirely non-overlapping. Such an offset arrangement of length portions of the closing element springs provides space for lint or dirt to avoid an increase in friction during operation of the needle.

In addition, it can be advantageous if the web area 47' does not fit with its entire length flush against the bottom of closing element channel 7. For this, the web area 47' has a step 58 that is shown in FIG. 9.

The guide section 48' of closing element spring 23' is offset against the guide section 35' of closing element spring 22' in longitudinal direction, such that the steps 38', 49' are located approximately at the same level or are arranged at a slight longitudinal distance to each other. Conceivable are furthermore applications where the closing element springs 22', 23' are realized such that the two steps 38', 49' overlap or are aligned with each other. The web areas 34', 47' are also arranged such that they do not overlap for the most part. The closing element spring 23' has a web section 52' that follows the guide section 48' and changes over to a plate-shaped section 54'. This latter section is mirror-symmetrical to the section 41' of closing element spring 22' and secures a loop support shoulder 55'.

Figure 10:
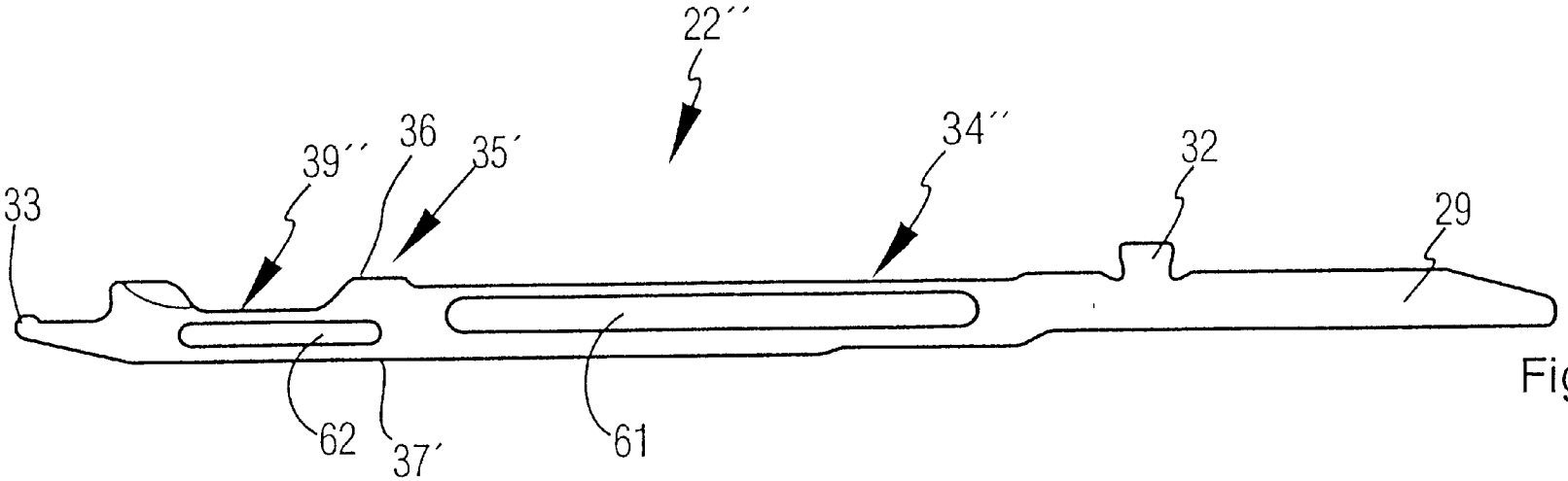
FIGS. 10 and 11 A schematic view from the side of the closing element springs of a compound needle in a modified design embodiment.
Figure 11:
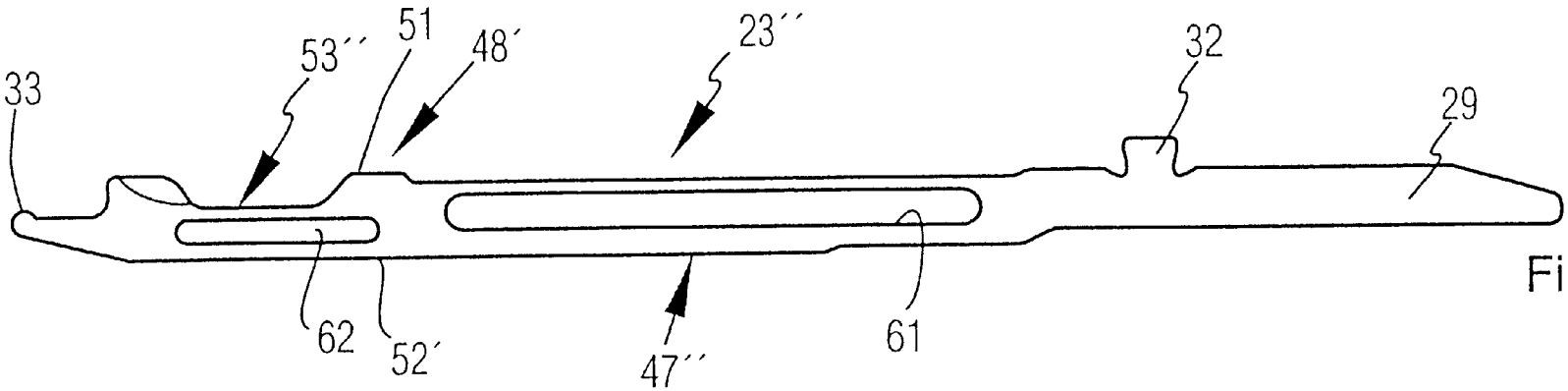

A modified embodiment of the compound needle 1 is obtained with the closing element springs 22", 23" in FIGS. 10 and 11. The closing element springs 22", 23" are designed to be mirror-symmetrical, wherein they have elongated hole-shaped openings 61, 62 in their web areas or web sections 34", 39" or 47", 53." The openings can serves as spaces where fibers or other deposits collect and through which they can be transferred, at least at times, to the region of opening 15 in the needle member 2, so that existing deposits can then be transferred to the needle channel. However, in some instances the sensitivity to being wedged in of a compound needle with closing element springs 22", 23" is somewhat higher than that of a compound needle with closing element springs 22, 23 or 22', 23' according to FIGS. 2, 3 or 8 and 9. Otherwise, the closing element springs 22", 23" coincide for the most part with the closing element springs 23', 23', so that we can point to the corresponding description based on the same reference numbers. The closing element springs 22", 23" can also have an asymmetrical design in that the openings 61, 62 are displaced against each other.

A compound needle 1 comprises a closing element 3 with two closing element springs 22, 23, which are designed asymmetrical to each other, or at least are provided with clearances or openings 34*a*, 47*a*. These openings are made to coincide during the compound needle 1 operation with a corresponding opening 15 or other openings in the base member 2 of compound needle 1, so that deposits can be removed to the needle channel. An asymmetrical design of the closing element springs 22, 23 prevents the closing element 3 from being wedged into the closing element channel 7, even if only an incomplete removal of the deposits occurs. The wear of the compound needle 1 is greatly reduced by this, thereby increasing the operational safety.

It will be understood that the above description of the present invention is susceptible to various modifications, changes and adaptations, and the same are intended to be comprehended within the meaning and range of equivalents of the appended claims.

What is claimed is:

1. A compound needle for knitting machines comprising (a) a needle member having a longitudinal direction;

(b) a closing element channel formed on said needle member;

(c) a closing element arranged longitudinally displaceably in said closing element channel and including a fastening location; and (d) two closing element springs extending through said closing element channel and being secured to said closing element at said fastening location; said closing element springs being asymmetrical relative to each other at least along portions thereof that extend through said closing element channel; said closing element springs having (1) web sections extending outward from said fastening location; and (2) guide sections constituting respective continuations of said web sections; said guide sections being offset relative to one another with respect to said longitudinal direction.

2. A compound needle for knitting machines comprising (a) a needle member including a closing element channel;

(b) a closing element arranged longitudinally displaceably in said closing element channel and including a fastening location;

(c) first and second closing element springs extending through said closing element channel and being secured to said closing element at said fastening location; each said first and second closing element springs having (1) a web section extending outward from said fastening location;

(2) a guide section constituting a continuation of said web section;

(3) a loop-holding nose; and (4) a region formed between said guide section and said loop-holding nose; said region of said first closing element spring being asymmetrical relative to said region of said second closing element spring.

3. A compound needle for knitting machines comprising (a) a needle member having a longitudinal direction;

(b) a closing element channel formed on said needle member;

(c) a closing element arranged longitudinally displaceably in said closing element channel and including a fastening location; and (d) two closing element springs secured to said closing element and extending through said closing element channel; said closing element springs being asymmetrical relative to each other at least along portions thereof that extend through said closing element channel; each closing element spring having an upper contact surface and a lower contact surface; said contact surfaces being at approximately the same distance from one another in said closing element springs.

4. A compound needle for knitting machines, comprising (a) a needle member;

(b) opposite walls formed on said needle member and defining a closing element channel; at least one of the walls having a discontinuity defining a laterally open region of said closing element channel for allowing removal therethrough of foreign bodies accumulated in said closing element channel;

(b) a closing element longitudinally displaceable in said closing element channel;

(c) two closing element springs secured to said closing element and extending through said closing element channel; at least one of said closing element springs having at least one opening moved at least briefly during the operation to said open region of said closing element channel.

5. A compound needle for knitting machines, comprising (a) a needle member;

(b) opposite walls formed on said needle member and defining a closing element channel; a surface of said needle member defining a bottom of said channel; said bottom having an opening defining an open region of said closing element channel for allowing removal, through said open region, of foreign bodies accumulated in said closing element channel;

(c) a closing element longitudinally displaceable in said closing element channel; and (d) two closing element springs secured to said closing element and extending through said closing element channel; at least one of said closing element springs having at least one opening moved at least briefly during operation to said open region of said closing element channel.

6. The compound needle as defined in claim 1, wherein said closing element springs are provided with openings.

7. The compound needle as defined in claim 6, wherein said openings in said closing element springs are arranged at different locations on said closing element springs.

8. The compound needle as defined in claim 6, wherein said openings in said closing element springs are partially overlapping.

9. The compound needle as defined in claim 1, wherein said web sections are essentially non-overlapping.

10. The compound needle as defined in claim 1, wherein said closing element springs are essentially non-overlapping.

11. The compound needle as defined in claim 1, wherein said asymmetrical portions of said closing element springs are positioned substantially in said closing element channel.

12. The compound needle as defined in claim 3, wherein said closing element channel has side walls having a height; and further wherein said closing element springs have a height greater than said height of said side walls, and said upper contact surfaces are situated above said side walls.

13. A compound needle for knitting machines comprising (a) a needle member having a longitudinal direction;

(b) a closing element channel formed on said needle member;

(c) a closing element arranged longitudinally displaceably in said closing element channel and including a fastening location; and (d) two closing element springs extending through said closing element channel parallel to said longitudinal direction and being secured to said closing element at said fastening location; said closing element springs having mutually longitudinally aligned length portions of unlike configuration, whereby said longitudinally aligned length portions have parts that are offset with respect to one another as viewed perpendicularly to said longitudinal direction.

14. The compound needle as defined in claim 13, wherein said longitudinally aligned length portions extend in their entirety at different height positions.

15. The compound needle as defined in claim 14, wherein said longitudinally aligned length portions are non-overlapping as viewed perpendicularly to said longitudinal direction.

* * * * *